US005309131A

United States Patent [19]

Hofsäss, deceased et al.

[11] Patent Number: 5,309,131

[45] Date of Patent: May 3, 1994

[54] THERMAL SWITCH

[75] Inventors: Peter Hofsäss, deceased late of Pforzheim, by Ulrika Hofsäss; administratrix, Marcel P. Hofsäss, Denise P. Hosäss, heir; by Henrik P. Hofsäss, heir; Münster; by Carola R. Hofsäss, heir; by Benjamin M. Hofsss, heir, both of Pforzheim; Jeans Radbruch, Neulingen; Guenter Kruck, Pforzheim, all of Fed. Rep. of Germany

[73] Assignees: Denis P. Hofsäss, all of Strietweg; Henrik P. Hofsäss, Münster; Carola R. Hofsäss; Benjamin M. Hofsäss, both of Strietweg, all of Fed. Rep. of Germany

[21] Appl. No.: 24,458

[22] Filed: Mar. 1, 1993

[30] Foreign Application Priority Data

Feb. 28, 1992 [DE] Fed. Rep. of Germany ..... 4206157

[51] Int. Cl.[5] ..... H01H 61/02; H01H 71/16

[52] U.S. Cl. ..... 337/102; 337/365; 337/377

[58] Field of Search ..... 337/102, 103, 104, 105, 337/106, 107, 365, 372, 377, 380

[56] References Cited

U.S. PATENT DOCUMENTS 4,539,545 9/1985 Klotz .
4,862,133 8/1989 Tabei .
5,014,035 5/1991 Hamada et al. .

*Primary Examiner*—Harold Broome
*Attorney, Agent, or Firm*—Antonelli, Terry, Stout & Kraus

[57] ABSTRACT

An easily and preferably fully automatically manufacturable thermal switch having a minimum number of parts is disclosed. The thermal switch has two connecting parts fixed to a support part. One connecting part carries a fixed contact and the other connecting part is connected through a high resistance to a movable contact switchable by a bimetallic element. The support part is a ceramic part forming the high resistance from a PTC material and the connecting parts are almost completely frictionally engage support part.

20 Claims, 3 Drawing Sheets

THERMAL SWITCH

TECHNICAL FIELD

The invention relates to a temperature or thermal switch with two connecting parts fixed to a support part, with one connecting part having a fixed contact and the other is connected in a high resistance manner to a movable contact switchable by a bimetallic element with the support part being a ceramic.

BACKGROUND ART

The invention is based on so-called open thermal switches, which are e.g. installed in electric heaters, such as electric radiators, hair dryers, etc. and cause a disconnection when an excess temperature occurs. It is also desirable with such switches that if the device has a malfunction, a "clocking", an opening and closing of the device, is prevented. Such a "clocking" can occur if, due to a malfunction of the device, there is an excess temperature, which opens the temperature switch, whose active switching element is generally a bimetallic element, so that there is no further current flow and a cooling can occur, through which the switch closes again and then, as a result of the malfunction of the device, an excess temperature again occurs and the switch reopens. To prevent this, a resistor is positioned in electrical parallel to the switch. In this connection thick-film resistors such as PTC resistors are known which are connected to the switch, e.g. by clips, shrink sleeves and the like.

DE-A-3,231,136 discloses a bimetallic switch with an insulating support part, in which are fixed connecting elements, in that e.g. the plastic carrier material is injection moulded around the connecting elements. From the connecting elements are bent tongues which carry the fixed and movable contact. Below the support part is provided a thick-film resistor in the form of a flat, conductively coated ceramic plate, which has rigid connection lugs, which are soldered to the connections lugs of the switch.

In addition to the aforementioned elements, the switch obviously also has a spring element carrying the movable contact stud, as well as a bimetallic disk for causing the switching process. The process has a complicated construction and is expensive to manufacture. Assembly operations must be carried out manually. It is also undesirable that the switch is made from numerous different materials, namely apart from the sheet metal of the connecting lugs, the switch is also made from plastic, ceramic and a conductive thick-film. It is also disadvantageous that the bimetallic element is fixed both at its ends and centrally, so that the switching action is reduced and it can also be exposed to permanent forces, which can modify the switching point.

DE-A-3,539,425 discloses a thermal switch. In this switch between prongs bent out from connecting lugs is positioned a thin, insulating ceramic plate which is soldered thereto. The ceramic plate is metallized and to one connecting lug is fixed a spring element of the movable contact. The other connecting lug is provided with the fixed contact stud. In the center of the spring element is fixed a rod or bolt, e.g. by means of a rivet traversing the bimetallic disk, which rests on the ceramic part. The ceramic part is also metallized, so that the metal coating forms the high-resistance, parallel resistor for keeping open the switch following opening by the bimetallic element. In practice, this switch has led to problems. It has a complicated construction, because the insulating ceramic plate must also be provided with a conductive coating. The opening through which the rod centering the bimetallic disk projects weakens the already thin ceramic plate, so that it can easily be broken. The switching path of the bimetallic disk is limited by the central fixing. The spring action and therefore the switching action of the spring carrying the movable contact is impaired by the rivet located thereon.

DISCLOSURE OF THE INVENTION

While avoiding the disadvantages of the known switches, the invention is based on the problem of providing an open, self-holding switch, which comprises a few components, has an uncomplicated construction and can be manufactured in a simple and substantially automated manner. According to the invention this problem is solved by the connecting parts engaging around the support part in an almost complete frictional manner. This permits a simple, automatic manufacture of a simply constructed switch. A reliable connection is obtained without it being necessary to have openings or holes for fixing rivets and the like in the ceramic support part. Such openings are complicated and cannot be manufactured with the desired precision while at the same time weakening the support part. According to a preferred development the support part is a PTC resistor.

The support part is constructed as a PTC resistor and carries the connecting elements. The support part is preferably shaped like a block or a parallelepiped, which is in particular not too thin and has a thickness, which is not significantly below half the parallelepiped width and is preferably over half the parallelepiped width. The PTC resistor performs the supporting function without there being any risk of breakage or damage. In a specific construction for fixing connecting lugs to the support part PTC resistor, the lugs almost completely engage around the support part. According to a preferred development the connecting lugs are soldered to the PTC resistor. A preferred embodiment has lugs formed on at least one connecting part by U-shaped punch-outs.

Alternatively one leg of the connecting part is bent by 180° below a further leg of the connecting part. Between the two parts is held a movable contact which is formed from bimetal or on one connecting element a leg is bent by 180° below another leg. Between the two legs there is both a movable contact and a bimetallic element switching the same. In the first-mentioned embodiment the active element, the bimetallic element, carries the movable contact stud, while in the second-mentioned development a bimetallic element acts on a spring carrying the movable contact stud. In both cases, according to a preferred development, there is a bent lug for the fixing of the movable contact and optionally the bimetallic element against the leg bent around by 180°. Optionally additionally a soldering can also be provided.

While fundamentally the bimetallic disk, in the manner known per se from the prior art, can be centrally mounted, in that it presses with the center against the spring and is supported with its edge on a rigid abutment or vice versa, according to the invention, the bimetallic element is only fixed on one side at the edge and with the diagonally facing side brings about the switching action. This also avoids openings in the ceramic part for receiving central centering or fixing elements for the bimetallic disk.

According to another preferred embodiment, the bent lug can be formed by a U-shaped punch-out from the leg under which the other leg was bent.

Further advantages and features of the invention can be gathered from the claims and the following description of a non-limitative embodiment with reference to the drawings, wherein show:

BEST MODE FOR CARRYING OUT THE INVENTION

Figure 1:
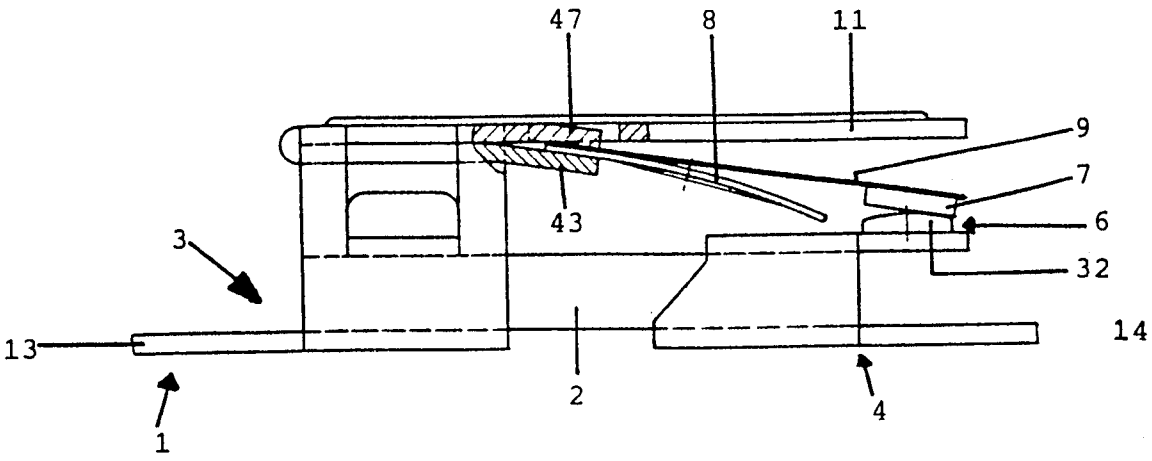
FIG. 1 is a side view of a thermal switch according to the invention.

In the represented embodiment, the thermal switch 1 according to the invention has the support part 2 which is a PTC resistor in the form of a parallelepiped manufactured from barium titanate or solid solutions of barium titanate and strontium titanate with further additives. Two connecting parts 3,4 are fixed in spaced manner on the PTC resistor 2. The connecting parts 3,4 are shown in detail in FIGS. 2 and 3. The connecting part 4 carries a fixed contact 6, while the connecting part 3 holds a movable contact 7, which is switchable by a bimetallic element 8 also fixed on the connecting part 3. Whereas the bimetallic element 8 could fundamentally be fixed e.g. by its center to an arm 11 projecting over a spring element 9 of the movable contact 7 (similar to the fixing in DE-A-3,539,425), in the illustrated embodiment it is fixed to one side at 12 and from there projects freely over its entire length. The arm 11 is provided with reinforcing corrugations 10 and consequently protects the sensitive switch mechanism 7,8,9, particularly on fitting the switch in an appliance so that no contact occurs, which could lead to a modification of the switching characteristics.

In a per se known manner the switch functions as a self-holding switch. If the ambient temperature becomes too high, either for external reasons, or due to an excessive power supply and heating of the conductive parts, so that the switching temperature of the bimetallic element 8 is exceeded, it switches from its low-temperature position allowing a low resistance contact between the contacts 6 and 7 as shown in FIG. 1, into its high-temperature position, in which the movable contact 7 is raised from the fixed contact 6. If in this way the low resistance connection across the contacts 6,7 is interrupted, then there is a current flow from the connecting lugs 13,14 across the PTC resistor 2, which is consequently heated which heat keeps the bimetallic element 8 in its high temperature position causing the contacts 6,7 in remain in the open position.

Figure 2:
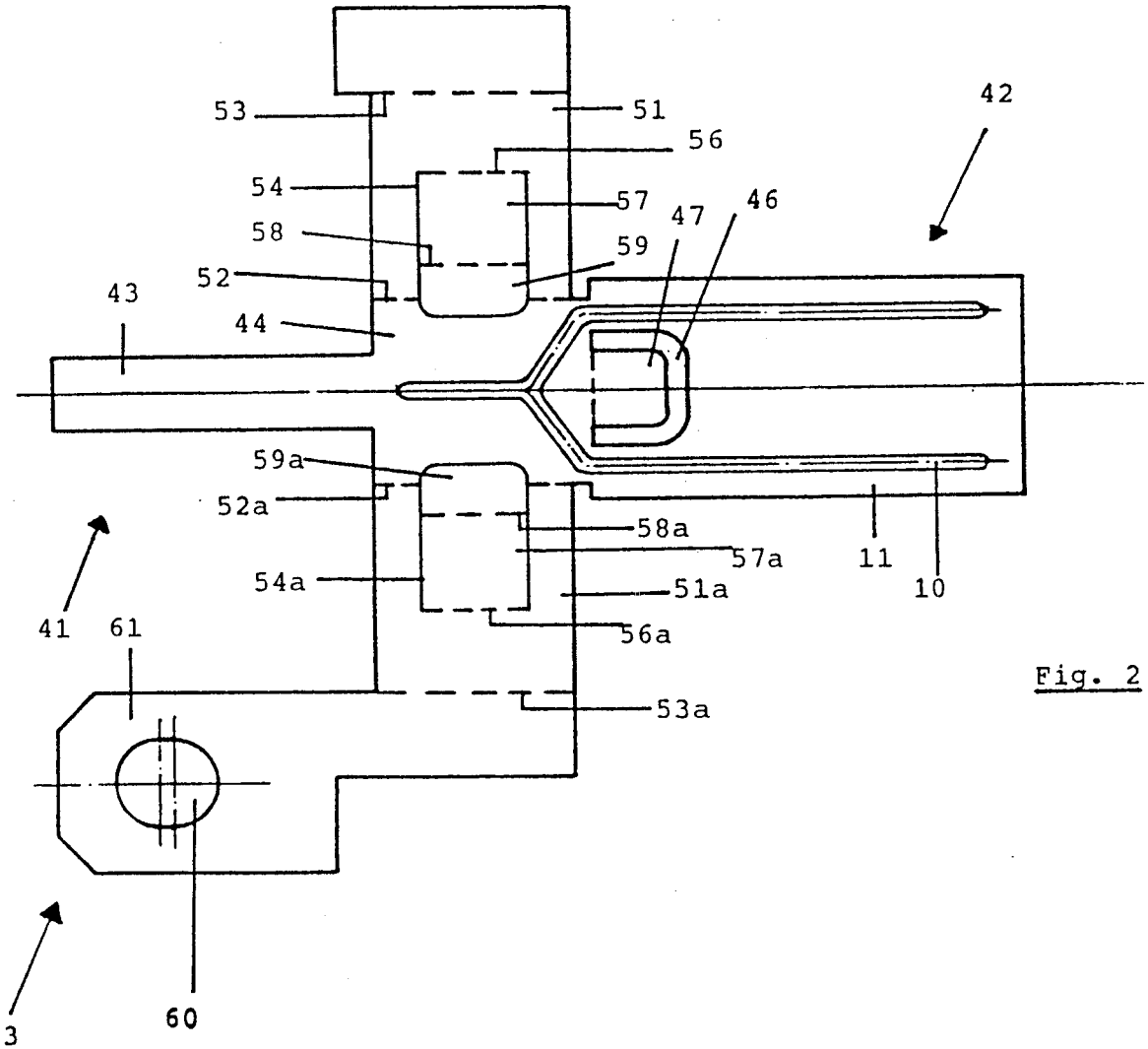
FIG. 2 is a view of the connecting part carrying the fixed contact.

The connecting part 4 illustrated in FIG. 2 is T-shaped. A central leg 21 forms the connecting lug 22 of the connecting element 4 and a bearing surface 23 for the PTC resistor 2. A T-web 24 of the T-shaped connecting element 4 is bent by 90° at lines **26,26*a*,27,27*a*, so that side walls 28,28*a* and cover parts 29,29*a* for the PTC resistor 2 are formed. The PTC resistor 2 can be frictionally held by the parts or walls 23,28,28*a*,29,29*a* bent along the lines 26,26*a*,27,27*a* by in each case 90°. However, preferably the connecting element 4 is soldered to the PTC resistor in the portions 23,28,28*a*,29,29*a* surrounding the said resistor. At the ends of the T-web 24 and the portions 29,29*a* are formed lugs 31,31*a* extending parallel to the external T-leg 21 and which come to rest parallel to one another after bending the connecting element 4 in the described manner. A contact stud 32 of FIG. 1 is fixed by welding thereto as the fixed contact 6**.

Figure 3:
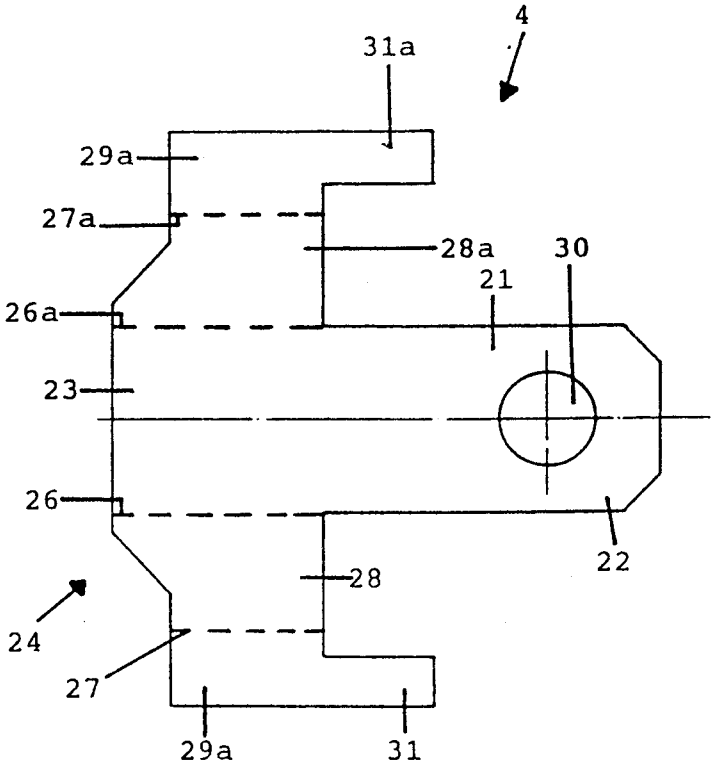
FIG. 3 is a view of the connecting part for the movable contact.

Like the connecting element 4, the connecting element 3 of FIG. 3 is made from flat material sheet metal. In the non-bent state shown in FIG. 3, it has the basic shape of a cross 41. A first leg 42 of the cross 41 forms the arm 11 projecting over the switching elements (spring element 9 with movable contact, bimetallic element 8). The leg or arm 43 facing the same is bent by 180° (FIG. 1) below the central part 44 of the cross 41 and the leg 42 and forms a lower holding part for the switching elements, namely the spring element 9 and bimetallic element 8. They are clamped between the same and a lug 47 punched out of the leg 42 by a U-shaped punch-out 46. Soldered connections can be provided for additional securing purposes. For this purpose, after bending around the leg 42, the lug 47 is bent downwards against the latter towards the PTC resistor 2, so that between it and the leg 42 are fixed the bimetallic element 8 and the spring element 9 as illustrated in FIG. 1.

Further legs 51 and **51*a* extend in opposite directions from the central part 44 of the cross and perpendicular to the legs 42,43. Legs 51 and 51*a* are bent downwards at bending lines 52,52*a* by 90°. Moreover, with a greater spacing than the spacing of the bending line 27 and 26 or 26*a* and 27*a*, of FIG. 2 corresponding to the thickness of the PTC resistor 2, they have further bending lines 53,53*a*, at which the legs 51,51*a* are being round in the same direction as at 52,52*a*. Thus, the bent round legs 51,51*a* form part of a rectangular contour. Spaced from the bending lines 53,53*a* are located the free ends of U-shaped punchouts 54,54*a*, through which at bending lines 56,56*a* are formed lugs 57,57*a* connected to the legs 51,51*a* and which are also bent down in the same direction about the bending lines 56,56*a* and are bent down in the opposite direction at 58,58*a*, at a distance from the bending lines 56,56*a* which just correspond to half the width of the PTC resistor 2, so that the free ends 59,59*a* of the lugs 57,57*a* are parallel to one another. The free ends 59,59*a* can optionally be welded together. As can be seen from FIG. 11, as a result of this shaping the PTC resistor is embraced and held by the connecting part 3 spaced from the connecting part 4 and soldered joints can be provided between the connecting part 1 and the PTC resistor 2 for additional securing purposes. On the free leg 51*a* and parallel to the lug 43, a connecting lug 61** is provided for producing the further contact for the switch according to the invention.

The switch according to the invention comprises a smaller number of parts than the prior art, namely the PTC resistor 2 forming a support part, the connecting parts 3,4, the bimetallic element 8, the spring element 9 and the contact studs 7,32, which are firmly connected, e.g. by welding or soldering to the spring element 9 or the connecting part 4.

The switch according to the invention is also manufactured in a simple, uncomplicated manner which can take place completely automatically.

The connecting parts 3,4 are punched from metal sheets with the contour shown in FIGS. 3 and 4. Simultaneously the rings 30,60 on the connecting parts 22,61 and the U-shaped punch-outs 46,54,54*a* are made. Subsequently reinforcing corrugations 50 are made in the arm 11 or the leg 42 and the central part 44 of the connecting part 3. On the connecting part 3 there is also the bending around of the leg 43 and also the bending around at the bending lines 53,53*a*,56,56*a*,57,57*a*, the bending taking place in the same way at the bending lines 26,26*a*, 27,27*a* on the connecting part 4. In a further stage of manufacturing the contact stud 43 is applied to the connecting part 3 while to the connecting part 3 are fixed the switching elements, namely the bimetallic element 8 and the spring element 9, with the contact stud, in that they are inserted between the end of the leg 42 and the lug 47 and by bending are fixed between the latter and the leg 42. Additional securing can be brought about by soldering. Finally, the prebent connecting parts 3,4 are engaged over the support part 2 (PTC resistor), are pressed frictionally therewith and optionally additionally soldered.

We claim:

1. A thermal switch comprising:

a switching unit and two connecting parts, the switching unit having a movable contact and a bimetallic element, the movable contact being switched by the bimetallic element;

a support part with the support part being a PTC resistor having a shape of one of a block or a parallelepipedic with an outside surface of the PTC resistor frictionally engaging the connecting parts; and wherein one connecting part has a fixed contact of the switching unit and the other connecting part is electrically connected to the movable contact; and the PTC-resistor is connected in electrical parallel with the switching unit to heat the PTC resistor causing the bimetallic element when in the open position of the movable contact to be held in a high-temperature position causing the bimetallic element to continuously hold the movable contact open.

2. A switch according to claim 1 wherein:

the support part is a PCT resistor containing one of or both of barium titanate and strontium titanate.

3. A switch according to claim 1 wherein:

lugs of the connecting parts engage the support part.

4. A switch according to claim 1 wherein:

the connecting parts are soldered to the support part.

5. A switch according to claim 1 wherein:

at least one connecting part has lugs formed by U-shaped punching lines.

6. A switch according to claim 1 wherein:

one leg of one of the connecting parts is bent by 180° below another leg of the one connecting part and between the two connecting parts is held a movable contact.

7. A switch according to claim 1 wherein:

a leg is bent by 180° on one of the connecting parts below another leg, a movable contact and the bimetallic element switching the movable contact.

8. A switch according to claim 6 wherein:

a bent lug fixes the movable contact against the one leg bent by 180°.

9. A switch according to claim 8 wherein:

the bent lug is punched by a U-shaped punch-out from another leg below which the one leg was bent.

10. A switch according to claim 1 further comprising:

an arm covering an area containing the contacts having reinforcing corrugations.

11. A switch according to claim 8 wherein:

the bent lug also fixed the bimetallic element.

12. A switch assembly in accordance with claim 1 wherein:

the frictional engagement of the connecting parts almost completely engages the PTC resistor.

13. A switch assembly in accordance with claim 2 wherein:

the frictional engagement of the connecting parts almost completely engages the PTC resistor.

14. A switch according to claim 3 wherein:

the frictional engagement of the connecting parts almost completely engages the PTC resistor.

15. A switch according to claim 4 wherein:

the frictional engagement of the connecting parts almost completely engages the PTC resistor.

16. A switch according to claim 5 wherein:

the frictional engagement of the connecting parts almost completely engages the PTC resistor.

17. A switch according to claim 6, wherein:

the frictional engagement of the connecting parts almost completely engages the PTC resistor.

18. A switch according to claim 7 wherein:

the frictional engagement of the connecting parts almost completely engages the PTC resistor.

19. A switch according to claim 8, wherein:

the frictional engagement of the connecting parts almost completely engages the PTC resistor.

20. A switch according to claim 9 wherein:

the frictional engagement of the connecting parts almost completely engages the PTC resistor.

* * * * *

UNITED STATES PATENT AND TRADEMARK OFFICE

CERTIFICATE OF CORRECTION

PATENT NO. : 5,309,131

DATED : May 3, 1994

INVENTOR(S) : Peter HOFSÄSS et al

It is certified that error appears in the above-identified patent and that said Letters Patent is hereby corrected as shown below:

On title page, item [75] change the inventor's name from "Jeans Radbruch" to --Jens Radbruch--; and On title page, item [73] insert the following: Ulrika Hofsäss and Marcel P. Hofsäss--.

Signed and Sealed this

Twenty-seventh Day of September, 1994

*Attest:*

Bruce Lehman

BRUCE LEHMAN

*Attesting Officer*

*Commissioner of Patents and Trademarks*